US007146747B2

(12) United States Patent
Studd et al.

(10) Patent No.: US 7,146,747 B2
(45) Date of Patent: Dec. 12, 2006

(54) TIMBER DRYING KILN

(75) Inventors: William Paul Studd, Wellington (NZ); Vaughan Raymon Furniss, Wellington (NZ); Peter Gibbs, Whitby (NZ)

(73) Assignee: Windsor Engineering Group, Wellington (NZ)

( * ) Notice: Subject to any disclaimer, the term of this patent is extended or adjusted under 35 U.S.C. 154(b) by 218 days.

(21) Appl. No.: 10/381,218

(22) PCT Filed: Sep. 25, 2001

(86) PCT No.: PCT/NZ01/00199

§ 371 (c)(1),
(2), (4) Date: Feb. 26, 2004

(87) PCT Pub. No.: WO02/25192

PCT Pub. Date: Mar. 28, 2002

(65) Prior Publication Data

US 2004/0187341 A1 Sep. 30, 2004

(30) Foreign Application Priority Data

Sep. 25, 2000 (NZ) ..... 507132
Mar. 29, 2001 (NZ) ..... 510842

(51) Int. Cl.
*F26B 3/00* (2006.01)
*F26B 21/06* (2006.01)
*F26B 21/10* (2006.01)
*F26B 21/12* (2006.01)

(52) U.S. Cl. ..... 34/396; 34/411; 34/423; 34/492; 34/497

(58) Field of Classification Search ..... 34/396, 34/411, 423, 471, 493, 497, 487, 492
See application file for complete search history.

(56) References Cited

U.S. PATENT DOCUMENTS

| | | | | |
|---|---|---|---|---|
| 3,902,253 | A | 9/1975 | Seiko | |
| 4,194,296 | A | 3/1980 | Pagnozzi et al. | |
| 5,276,980 | A | 1/1994 | Carter et al. | |
| 5,595,000 | A * | 1/1997 | Goodwin, III | 34/471 |
| 5,836,086 | A | 11/1998 | Elder | |
| 6,014,819 | A | 1/2000 | Elder | |
| 6,119,364 | A | 9/2000 | Elder | |

FOREIGN PATENT DOCUMENTS

| | | |
|---|---|---|
| EP | 0122902 | 8/1990 |
| JP | 200351103 | 11/1999 |
| WO | WO85/02250 | 5/1985 |
| WO | WO99/09364 | 2/1999 |

* cited by examiner

*Primary Examiner*—Jiping Lu
(74) *Attorney, Agent, or Firm*—Carlton Fields PA

(57) ABSTRACT

A multichamber timber drying kiln in which different conditions are maintained in each chamber and methods of drying timber using such a kiln. In one aspect timber is rapidly heated within a first chamber (2; 202; 207) and then transferred to a further chamber (3; 203; 208) for further drying. Timber may be transferred from the first chamber (2; 202; 207) when the moisture content of the timber approaches the fibre saturation point A preheating chamber (1; 201; 206) may be provided to preheat the timber before passing to the first chamber (2; 202; 207). A conditioning chamber (4; 204; 209) may be provided after the further chamber (3; 203; 208) to condition the timber. Energy transfer means (49–53; 54–58) may be provided to transfer energy between chambers.

13 Claims, 11 Drawing Sheets

TIMBER DRYING KILN

TECHNICAL FIELD

This invention relates to an improved kiln and in particular, but not exclusively to a timber drying kiln with a plurality of discrete chambers, the conditions within each chamber being controllable for different stages of the drying process.

The kiln of the invention is particularly suitable for use in high temperature kilns. The term "high temperature" is used in the specification to include high temperature (110°–160° C.), super high temperature (160°–200° C.) and ultra high temperature (200° to 260° C.) operation. However the invention may also find application in medium temperature (60°–110° C.) operation.

BACKGROUND OF THE INVENTION

Timber Drying Kilns are used for reducing the moisture content of green sawn timber to a desired level. For best results the timber should be exposed to a sequence of closely controlled atmospheric conditions. This has been achieved in single chamber kilns by holding the timber stationary in the kiln and varying the conditions, or by gradually moving the timber through a chamber in which conditions vary continuously between the inlet and the exit.

Such Kilns typically consist of a single chamber of relatively large capacity and volume. Generally, the larger the chamber the less uniform and precise the conditions experienced by the timber within the kiln. Such kilns require large plant to perform the required heating and cooling operations required within each cycle. As it is difficult to rapidly change and control the conditions within such kilns the emission of volatile organic chemicals may also be a problem. Wood fibres do not increase in temperature substantially until most of the free moisture in the timber is removed. Once the moisture content of timber drops below the "fibre saturation point" (usually about 25% moisture content) volatile organic chemicals may be released when the wood fibres become heated to temperatures above about 120° C. In a standard batch kiln, particularly during high temperature operation, it is difficult to avoid heating the timber above about 120° C. when the moisture content drops below this level.

U.S. Pat. No. 3,902,253, EP122902 and WO85/02250 disclose "drive through chamber" type kilns in which a timber stack is moved between kiln chambers during a drying process. Light weight partitions or curtains are used to isolate adjacent chambers. Due to relatively low thermal insulation provided between chambers the degree to which different conditions may be maintained in adjacent chambers is limited. Further, there is no controlled transfer of the heating medium between chambers. Such kilns may only be suitable for low or medium temperature operation.

U.S. Pat. No. 3,902,253 discloses a five stage kiln suitable for medium temperature operation. The drying time in each stage is four hours making a total drying time of 20 hours. In WO85/02250 FIG. 3 indicates that conditions vary relatively continuously throughout the kiln. WO85/02250 and EP122902 give no specific details as to the operating conditions but appear to be suitable only for low or medium temperature operation.

It is an object of a preferred embodiment of the invention to provide a timber drying kiln which will overcome or at least ameliorate problems in known timber drying kilns, or methods of operating them, or at least to provide the public with a useful choice.

SUMMARY OF THE INVENTION

According to one aspect of the invention there is provided a method of drying timber in a timber drying kiln having a plurality of chambers including the steps of:

i/ supplying timber to a first chamber in which the dry bulb temperature is maintained between 120° to 260° C., the wet bulb temperature is maintained between 90° to 100° C. and the air speed is maintained between 8 to 18 meters per second; and ii/ transferring the timber to a further chamber in which the dry bulb temperature is maintained between 80° to 130° C., the wet bulb temperature is maintained between 70° to 100° C. and the air speed is maintained between 5 to 12 meters per second.

The timber is preferably transferred to the further chamber after a substantial proportion of the moisture content of the timber has been removed. Preferably the timber is transferred to the further chamber when the moisture content approaches the fibre saturation point. Where a multichamber kiln is used steam conditioning of the timber is preferably performed in the final chamber to achieve substantially uniform moisture content throughout the timber.

According to a further aspect of the invention there is provided a timber drying kiln including:

at least one heating chamber;

a conditioning chamber;

process control means to control processing conditions within each chamber;

a timber transfer system for transferring timber between chambers; and energy transfer means for transferring energy from the at least one heating chamber to the conditioning chamber.

The energy transfer means may transfer the heating medium (eg steam and air) between chambers or may extract energy from one chamber and supply it to another chamber by use of a heat pump. The energy transfer means may consist of ducts between chambers with the heating medium driven through the ducts by fans.

The kiln preferably consists of a plurality of drying chambers and a conditioning chamber. Passages are preferably provided between adjacent chambers which may be opened to convey timber between respective chambers and closed when timber is within a respective chamber. Transporting means preferably convey the timber between the chambers.

The kiln preferably consists of first and second rapid drying chambers, a third drying and equalising chamber and a fourth equalising, cooling and conditioning chamber. Heat may be exchanged between the first and second chambers and the third and fourth chambers.

According to a further aspect of the invention there is provided a method of drying timber in a timber drying kiln including a plurality of discrete chambers including the steps of:

i/ supplying timber to a heating chamber(s) and maintaining a dry bulb temperature in the drying chamber(s) of greater than 120° C. for at least part of a drying stage; and ii/ when the moisture content of the timber is near or approaching the fibre saturation point, transferring timber to a subsequent chamber or chambers in which a dry bulb temperature of less than 120° C. is maintained to further dry and equalize the timber.

Preferably the drying chamber(s) consists of two drying chambers. Preferably the subsequent chamber(s) consists of a drying and equalizing chamber followed by an equalizing, cooling and conditioning chamber.

Preferably the dry bulb temperature within the heating chamber(s) is greater than 120° C. for the majority of the drying process, more preferably substantially the entire drying process.

According to a further aspect of the invention there is provided a method of drying timber in a timber drying kiln, including a plurality of discrete chambers including the steps of:

i/ supplying timber to a heating chamber(s) and rapidly heating the timber; and ii/ transferring the timber to a conditioning chamber in which the timber is conditioned with steam so as to achieve a substantially uniform moisture content throughout the timber.

Steam from the heating chamber(s) is preferably used to supply steam to the conditioning chamber. The dry bulb temperature in the first and second chambers is preferably between 70° C. to 260° C. and the wet bulb temperature is preferably between 60° C. to 100° C. More preferably the dry bulb temperature is between 120° C. to 260° C. and the wet bulb temperature is between 90° C. to 100° C. The dry bulb temperature within the conditioning chamber is preferably between 70° C. to 100° C. and the wet bulb temperature is preferably between 80° C. to 100° C.

BRIEF DESCRIPTION OF THE DRAWINGS

Further aspects of the present invention will become apparent from the following description given by way of example and with reference to the accompanying drawings in which.

BRIEF DESCRIPTION OF PREFERRED EMBODIMENTS OF THE INVENTION

The present invention will be described with particular reference to its use in progressively drying plantation softwoods such as pine (softwood) species timber. It will be appreciated that the invention is equally applicable to other varieties with appropriate process modifications.

For simplicity the description will refer to the operation in the kiln during normal operation, at a time after all the chambers of the kiln have been filled for the first time.

Figure 1:
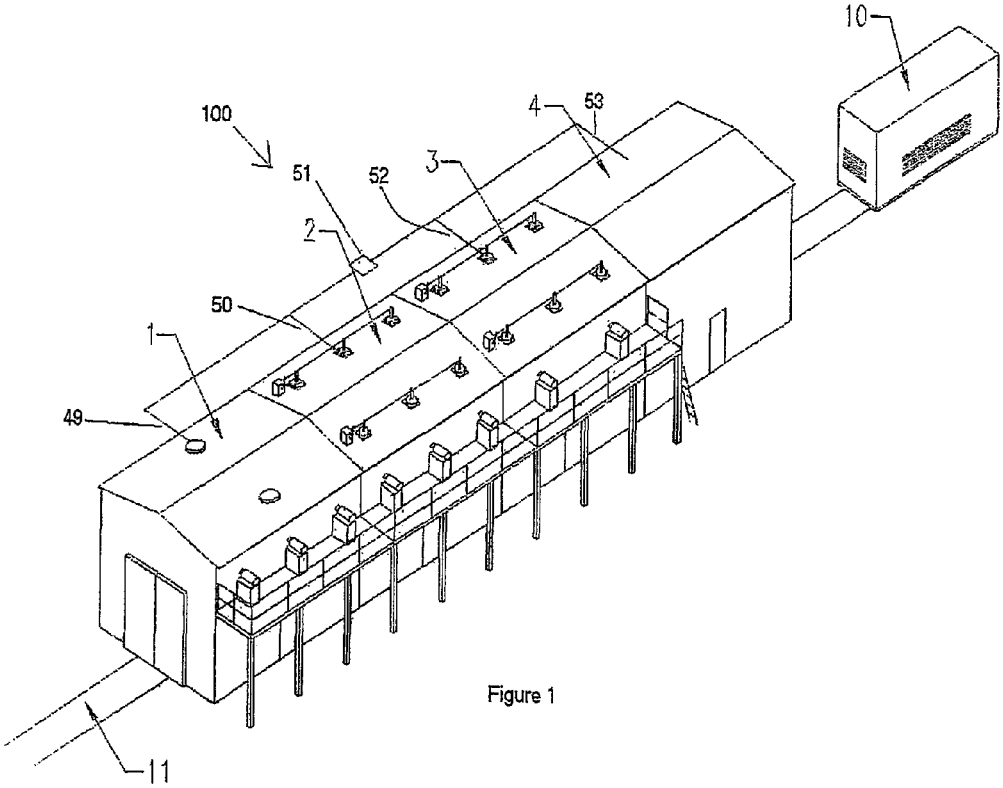
FIG. 1: Shows an isometric view of the exterior of a kiln according to one possible embodiment of the invention.
Figure 2:
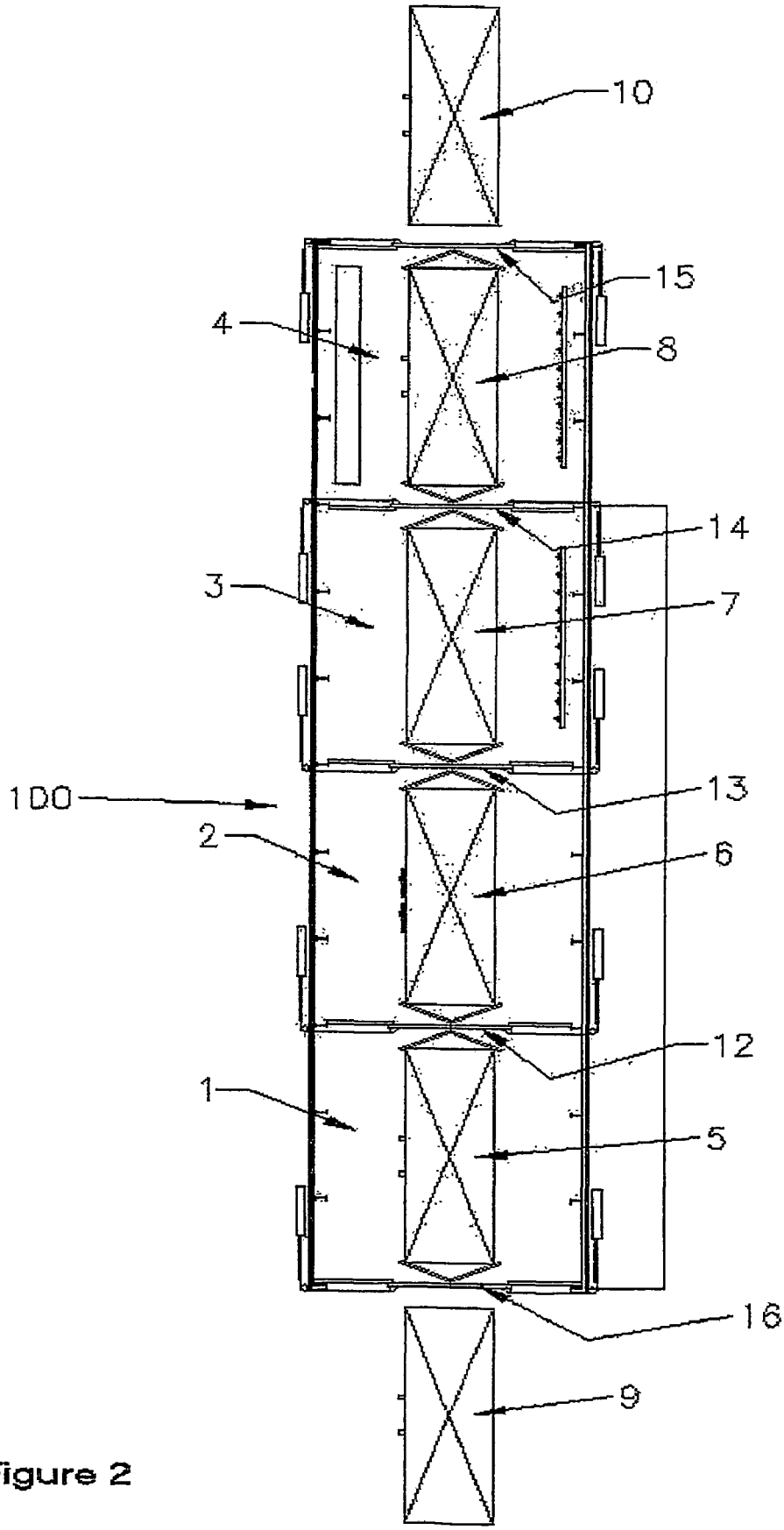
FIG. 2: Shows diagrammatically a plan view of the kiln with timber stacks stationary in each chamber.

Referring first to FIGS. 1 and 2, a kiln 100 has four discrete chambers 1, 2, 3 and 4 with specific atmospheric conditions maintained in each. The chambers 1, 2, 3 and 4 are substantially thermally isolated from one another by insulated doors 12 to 14. The doors preferably have a thermal conductivity of less than 0.05 watts/$m^2$K. Sensors may be provided to monitor the conditions in each chamber. Each chamber 1, 2, 3 and 4 contains a stack of timber 5, 6, 7 and 8 respectively, each at a different stage of the drying process. Additionally a green stack 9 awaits entry to the kiln and a fully processed stack 10 awaits dispatch from outside the exit of the kiln.

Figure 6:
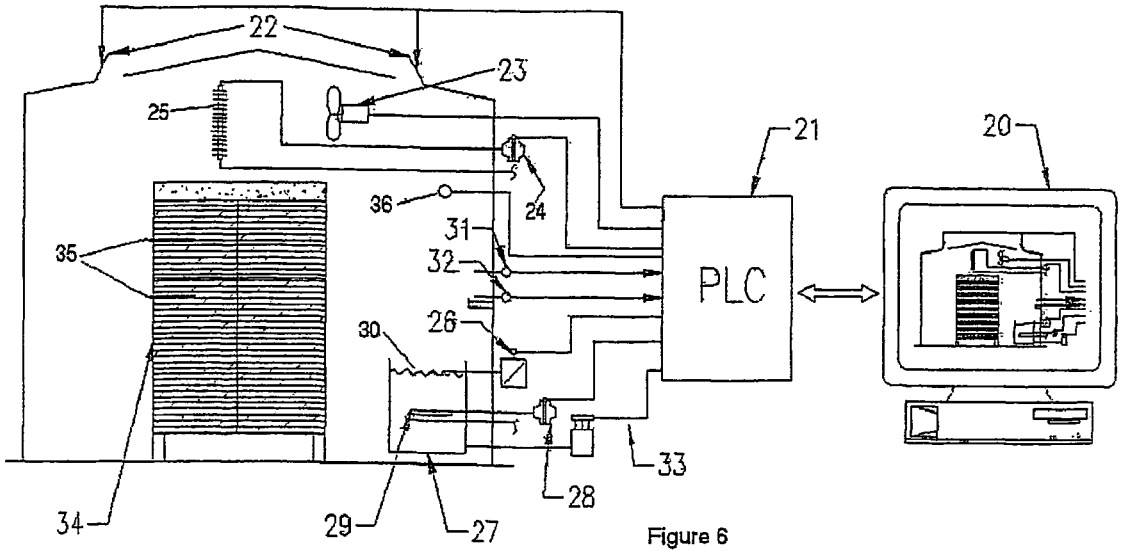
FIG. 6: Shows schematically the sensors, plant and computer of the process control means of a chamber of the kiln shown in FIGS. 1 to 5.

FIG. 6 shows a generic chamber and a computer 20 running DRYSPEC™ software connected via a programmable logic controller (PLC) 21 to sensors and plant to be controlled. Modulating vents 22 may be opened and closed by PLC 21 under control of computer 20 to vent the chamber. Heater coil control valve 24 to heater coil 25 is controlled by PLC 21 under the control of computer 20 to control the supply of heat to the chamber. Steam bath cold water valve 26 is controllable by PLC 21 to control the supply of water to steam bath 27. Steam bath 30 may alternatively receive recycled condensate from the chamber floors in a closed loop system to reduce the amount of fluid waste requiring treatment. Valve 28 is controlled by PLC 21 to control the flow of heating fluid to steaming coil 29. When valve 28 is open a heating fluid, such as steam passes to steaming coil 29 so that steam is generated from steaming bath 30.

PLC 21 receives information from a variety of sensors and provides this information to computer 20. Dry bulb sensor 31, wet bulb sensor 32 and steaming bath water level probe 33 all provide sensor information to PLC 21. Moisture content sensors may also be provided within wood stack 34 so that moisture content information may be provided to PLC 21. Conductive sheets 35 may be placed within or beside the stack 34 so that capacitance can be measured between timber using a system such as the DRYZONE™ system. Alternatively, conductive fillets may be placed within the stack of timber and resistance measurements taken according to the DRYLINE™ system. Signals may be conveyed from the sensors via tracks 11 or cables or via a wireless connection. Microwave and acoustic moisture content measurement systems may also be provided which can provide moisture content information to PLC 21. Further, air flow information can be obtained by an air flow sensor 36 and provided to PLC 21.

FIG. 6 shows a generic chamber and it will be appreciated that some components will be required in some chambers and not in others. For example, the steam bath 30 and its associated elements may only be required in the fourth chamber. A single PLC 21 may control the conditions within a plurality of chambers independently.

The doors 12 to 16 may be controllable by PLC 21 to control the opening and closing thereof. Stacks of timber 5 to 9 may be stacked upon trolleys which run along tracks 11 through the kiln. The trolleys may be advanced through the kiln under the control of PLC 21. The doors are well insulated to allow substantially independent control of conditions within respective chambers.

The first processing step within chamber 1 is a rapid heating and drying step which provides plasticisation of the hemicellulose within the wood structure of the resident timber stack 5. Preferably fully saturated steam conditions are maintained in the chamber 1 with little or no applied venting to atmosphere to discharge moisture laden air.

The next processing step is a rapid drying step within chamber 2. Preferably the environment in the second chamber 2 is held at the required operating conditions by a DRYSPEC™ computer or the like, in order to promote drying of the resident stack 6. Preferably the moisture laden air in the chamber 2 is automatically vented to promote rapid drying of the timber. This moisture laden air may be utilised in later stages as discussed below.

The third processing step is a drying and equalizing step within chamber 3. In the third chamber 3 a control apparatus, which may be of the computer controlled type known as DRYLINE™ 9 (New Zealand Patent Number 328458), may monitor the average moisture content of the timber. This may be by measuring the electrical resistance presented by one or more boards in the stack. The DRYLINE™ apparatus may interact with the DRYSPEC™ kiln computer control system to ensure that the average moisture content of the timber 7 in the chamber 3 conforms exactly to timber market specifications before leaving the third chamber 3.

Preferably the environment in the third chamber 3 may be held at the required operating conditions by the DRYSPEC™ computer to promote cooling, moisture equalization, and final drying of the resident timber stack 7. Maintaining the temperature within the desired ranges given in the tables below ensures the wood fibre temperature will not exceed about 110° C., at which temperature relatively low amounts of volatile organic compounds are released. To further minimise such emissions a lower temperature may be maintained in chamber 3 in conjunction with higher air speeds.

The stack 8 in the fourth chamber 4 may undergo a steam reconditioning process to provide stress relief and surface treatment to the timber. This step may or may not be required depending upon the characteristics and end use of timber being dried. Steam may be provided from a steam bath 30 of the type shown in FIG. 6. Alternatively, or in conjunction, steam from chamber 1 or 2 may be extracted and introduced into chamber 4. It is preferred that excess energy from the first and/or second chambers is transferred to the third and/or fourth chambers for overall co-inefficiency.

FIG. 1 illustrates a first energy transfer means for transferring energy from the first and second chambers to the third and fourth chambers. Heating medium (steam and air) may be extracted from chambers 1 and 2 via ducts 49 and 50. Vents between chambers 1 and 2 and ducts 49 and 50 may be opened and closed by PLC 21 to control the amount of heating medium extracted from each chamber. Fan 51 may be driven by PLC 21 to control the flow rate of heating medium from chambers 1 and 2 to chambers 3 and 4 via ducts 52 and 53. Again, vents between ducts 52 and 53 and chambers 3 and 4 may be controlled by PLC 21 to control the amount of heating medium flowing into each chamber. The various vents may be independently controlled depending upon the conditions within each chamber and the operating phase of the kiln.

Figure 7:
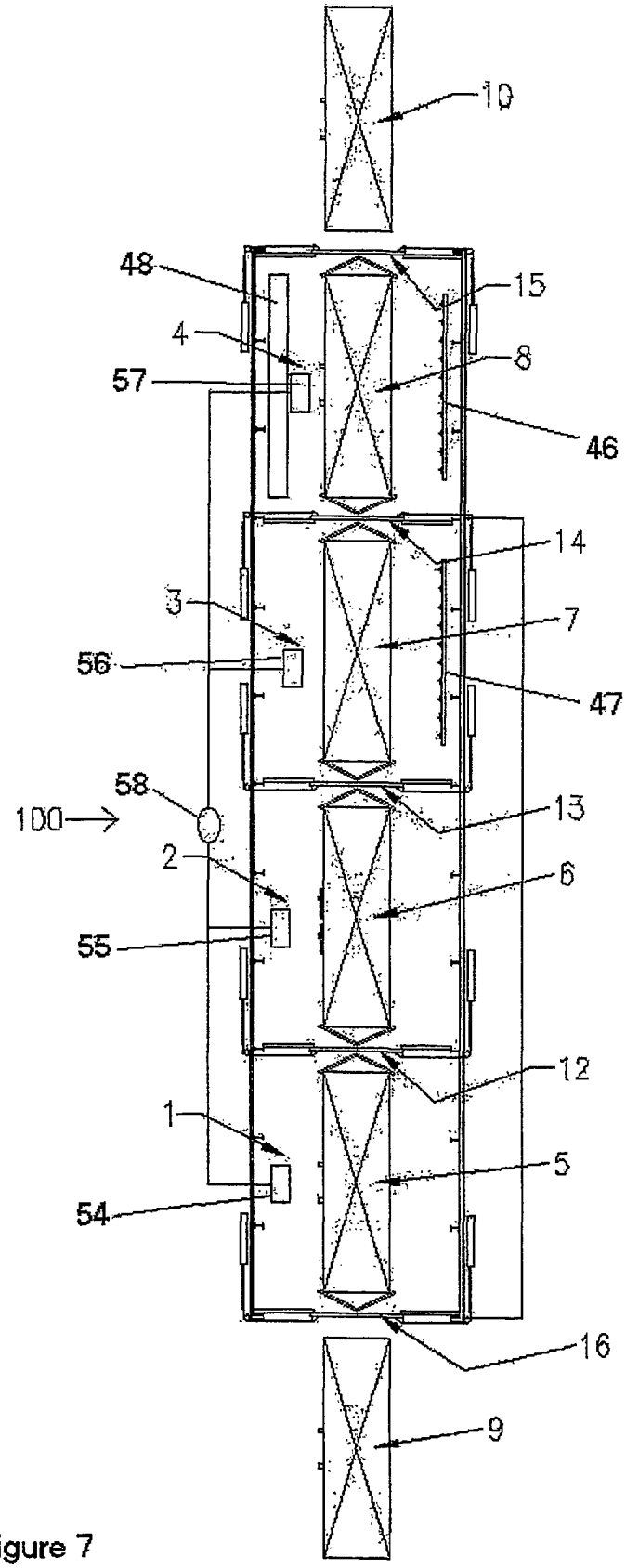
FIG. 7: Shows an alternate energy transfer system

Referring now to FIG. 7 an alternative energy transfer means is shown. In this case heat is extracted from chambers 1 and 2 by coils 54 and 55 and pumped via pump 58 to coils 56 and 57 to heat chambers 3 and 4. Again, the flow of heating fluid through each coil 54 to 57 may be independently controlled via suitable valves so that heat is extracted and supplied at an appropriate rate to or from each chamber.

The kiln of the present invention may be particularly advantageous for rapid drying under high temperature operation. Due to the insulated doors provided between chambers, substantially different operating conditions can be maintained within each chamber. By maintaining the temperature in chambers 3 and 4 below a level at which substantial amounts of volatile organic chemicals are emitted reduces emission problems. Further, water spray cooling in chamber 3 and/or chamber 4 by water spray coolers 46 and 47 and steam reconditioning the timber in chamber 4 enables a rapid drying schedule to be utilized. The preferred operational ranges for high temperature operation are shown below in Table 1.

TABLE 1

HIGH TEMPERATURE OPERATION

| | DB° C. | WB° C. | Air Speed m/s |
|---|---|---|---|
| Chamber 1 | | | |
| Possible Range | 120–260 | 90–100 | 8–18 |
| Preferred Range | 140–160 | 90–100 | 10–12 |
| Chamber 2 | | | |
| Possible Range | 120–260 | 90–100 | 8–18 |
| Preferred Range | 140–150 | 90–100 | 10–12 |
| Chamber 3 | | | |
| Possible Range | 80–130 | 70–100 | 5–12 |
| Preferred Range | 110–120 | 70–80 | 5–8 |
| Chamber 4 | | | |
| Possible Range | 80–100 | 80–100 | 8–15 |
| Preferred Range | 85–100 | 85–100 | 10–12 |

*Where DB° C. is the dry bulb temperature within the chamber and WB° C. is the wet bulb temperature within the chamber.

Timber stacks will typically remain in each chamber for between 0.5 to 5 hours per chamber. For some pine species total drying time can be as little as 2½ hours under ultra high temperature operating conditions.

The kiln of the invention may also be utilised for medium temperature kiln drying operations. Preferred operating conditions for medium temperature operation are set out in Table 2 below.

TABLE 2

MEDIUM TEMPERATURE OPERATION

| | DB° C. | WB° C. | Air Speed m/s |
|---|---|---|---|
| Chamber 1 | | | |
| Possible Range | 70–110 | 60–85 | 4–7 |
| Preferred Range | 70–90 | 60–80 | 5–6 |
| Chamber 2 | | | |
| Possible Range | 70–110 | 60–85 | 4–7 |
| Preferred Range | 70–90 | 60–80 | 5–6 |
| Chamber 3 | | | |
| Possible Range | 70–90 | 75–85 | 3–5 |
| Preferred Range | 80–90 | 70–80 | 3–4 |
| Chamber 4 | | | |
| Possible Range | 70–100 | 90–100 | 0–2 |
| Preferred Range | 90–100 | 95–100 | 0–1 |

Figure 3:
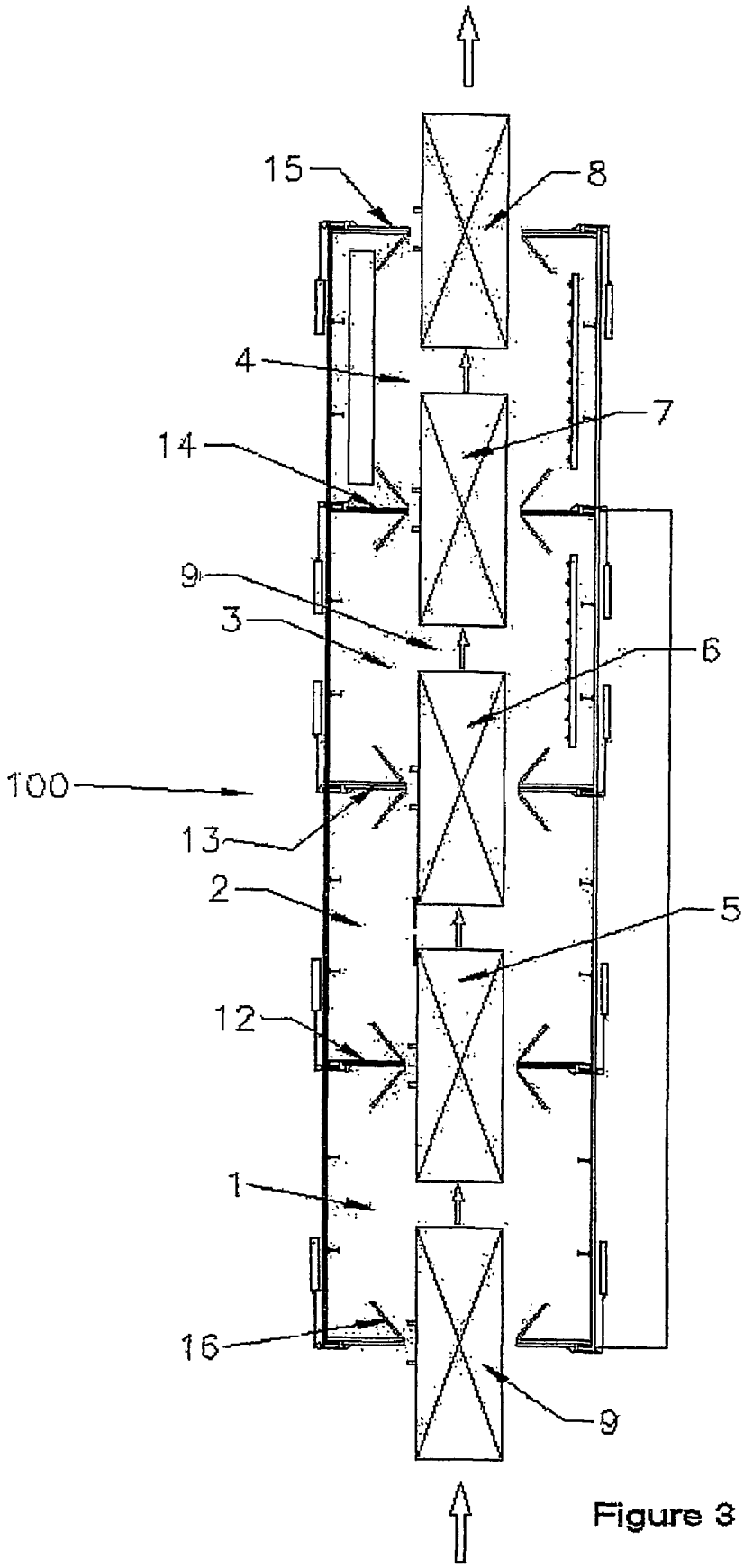
FIG. 3: Shows diagrammatically a plan view of the kiln with timber stacks moving from one chamber to the next chamber.

Referring next to FIG. 3, after a time period determined by either elapsed time or measured moisture content of the timber, each stack 5, 6, 7 moves along track 11 to the next chamber. The movement of stacks may be simultaneous, sequential or independent. In this case simultaneous movement is described. Stack 5 moves through self opening doors 12 to chamber 2, stack 6 moves through self opening doors 13 to chamber 3, stack 7 moves through self opening doors 14 to chamber 4. Simultaneously stack 8 exits the kiln through self opening doors 15 to a position outside the kiln for collection, and a new stack 9 enters the kiln through self opening doors 16 into the first chamber 1. A suitable material handling system may control the movement of the stacks based, for example, on automatic moisture content measurements of the timber stacks at particular stages or intervals.

The above process may be repeated continuously with a new greed stack entering the first chamber 1 at the same time as a fully processed dry stack leaves the fourth chamber 4, so that each chamber always contains one stack of timber, and each stack of timber which enters the kiln is subjected to the same sequence of conditions between entry and exit of the kiln.

Figure 4:
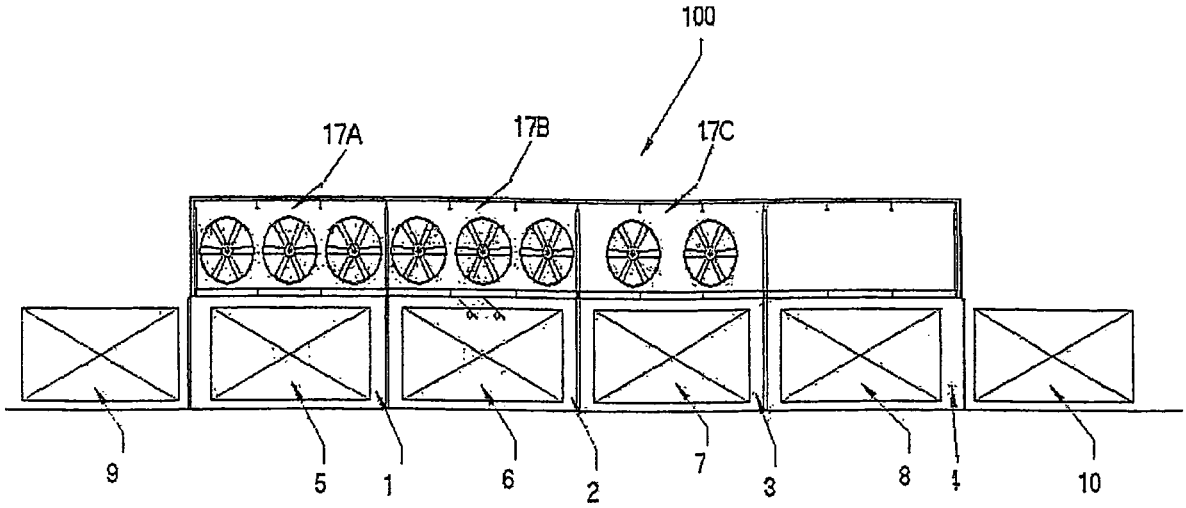
FIG. 4: Shows diagrammatically a side view of the kiln of the preceding figures.
Figure 5:
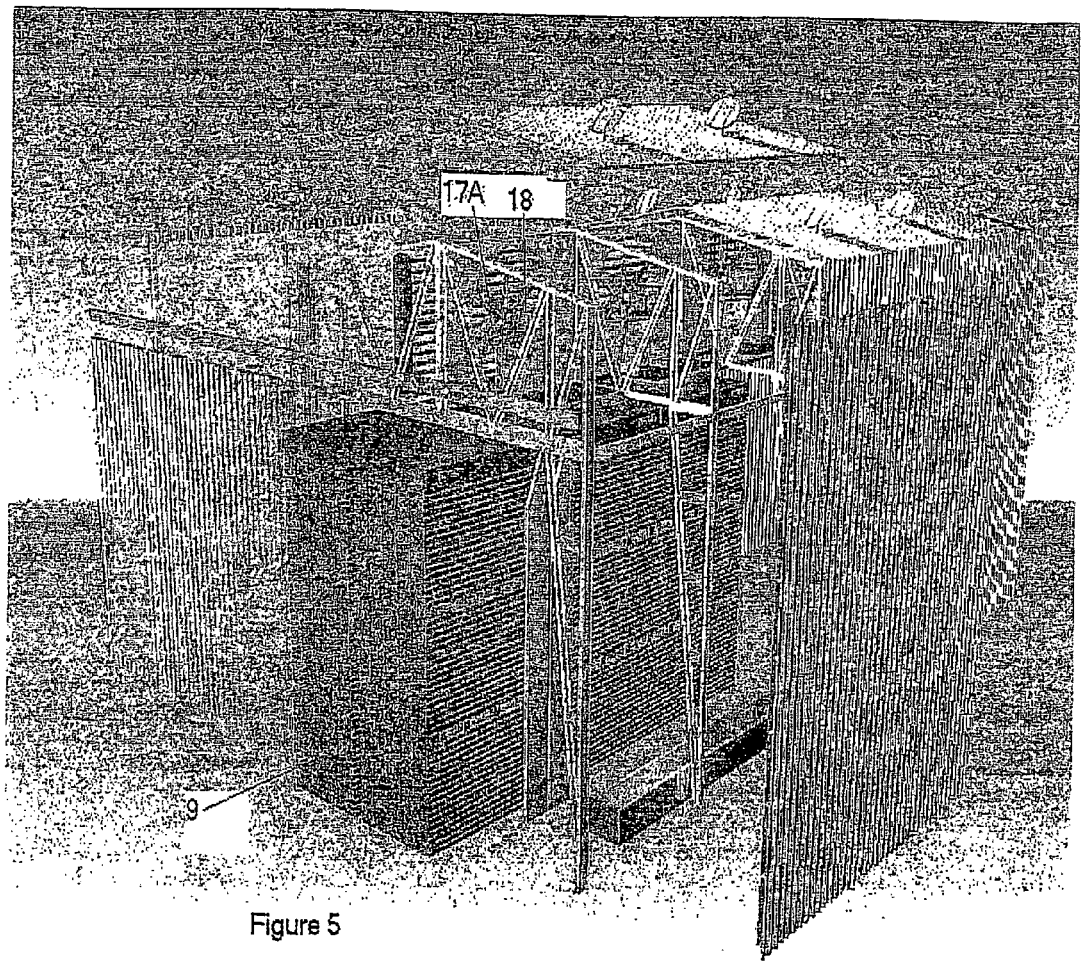
FIG. 5: Shows an exploded view of one possible embodiment of a chamber of the kiln of FIG. 4.

Referring particularly to FIGS. 4 and 5 the side view shows sets of fans 17A, 17B and 17C of different capacity, driven by motors 18, providing the required airflows in the respective chambers 1, 2 and 3. Alternatively the fans 17 could be of substantially the same size but having their operation controlled by suitable control means such as variable speed drives etc. By providing the fans above the timber stacks high air flows through the timber stacks can be achieved, thus allowing faster drying.

In the example shown in the attached figures the chambers 1 to 4 are seen to be of about the same size and each stack of timber moves sequentially through each chamber spending the same amount of time in each chamber. Typically each stack of timber may spend about two hours in each chamber during processing for high temperature operation. Chambers 1 to 4 may be of different dimensions and the stacks of timber may spend different amounts of time in each chamber. For example, chamber 1 could be a quarter of the size of chambers 2 to 4 so that each stack of timber spends half an hour in the first chamber and two hours in each subsequent chamber. These times may be altered depending upon the timber species, and use and the process concerned.

Alternatively batches of timber may move successively through the kiln spending different amounts of time in each chamber. For example, several independently moveable stacks of timber may be located within each chamber and moved independently between chambers. Sets of parallel tracks may be provided within each chamber between which stacks of timber may be transferred to allow independent movement of timber stacks. It will be appreciated that a wide range of material handling systems could be employed to move the stacks between the chambers and that the invention is in no way limited to the use of carts on rails. The chambers may be sized according to the required dwell time within each chamber. However, it is preferred that the stacks of timber move substantially sequentially from chamber to chamber and have an approximately equal dwell time within each chamber for simplicity of construction, production management for flow of end product.

In another embodiment the kiln may be manufactured as a continuous tube with the ends thereof sealed with movable dividers defining the respective chambers. Such moveable dividers would enable the chamber size of each chamber to be adjusted according to timber size and processing requirements. This would enable the kiln to be configurable for any particular processing.

Figure 8:
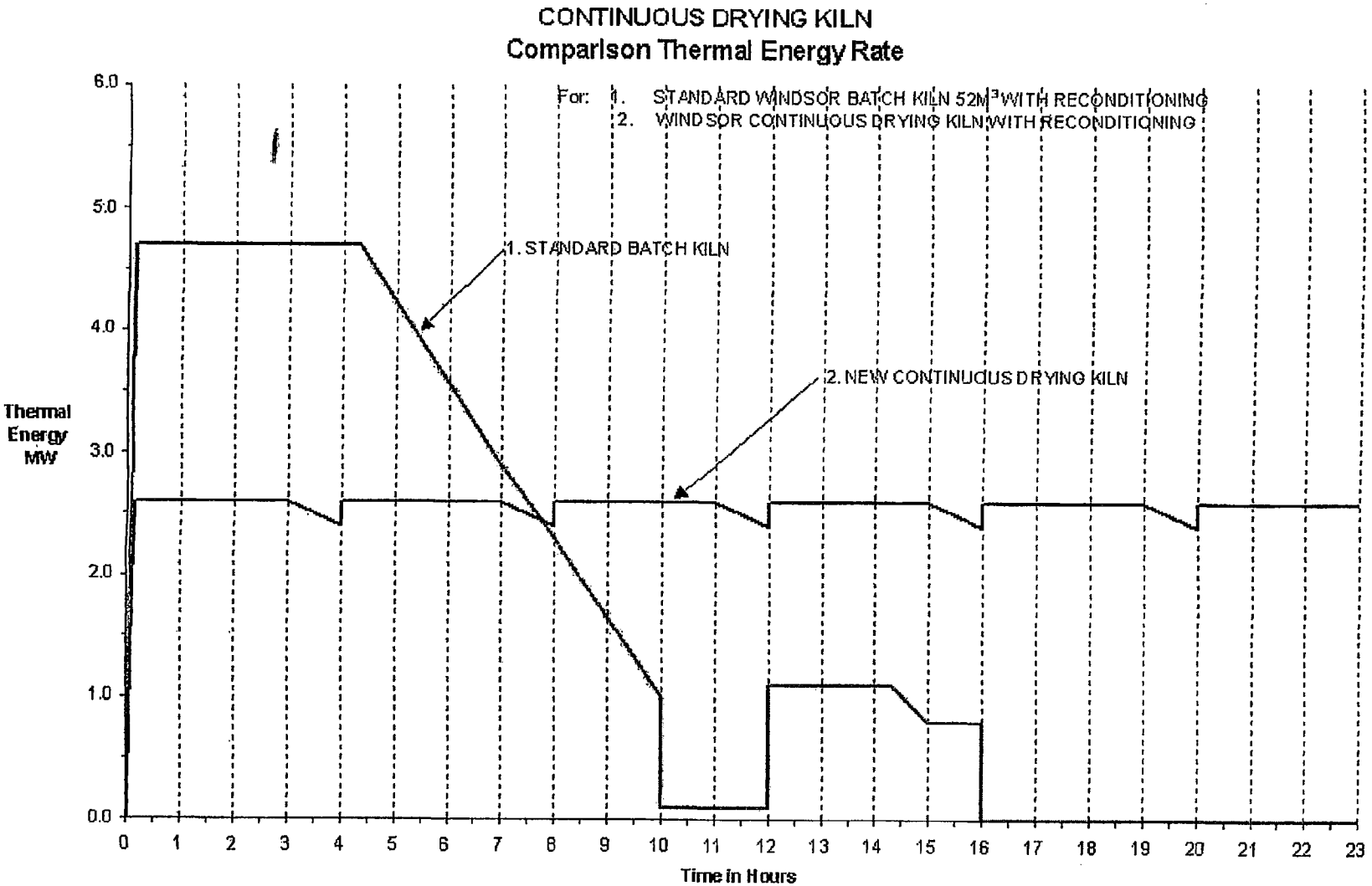
FIG. 8: Shows the thermal energy requirements of the kiln shown in FIGS. 1 to 6 compared to the thermal energy requirements of a standard batch kiln.

The kiln and method of the present invention utilize a plurality of smaller chambers to achieve drying. The conditions within smaller chambers are more uniform and precisely controllable and so better drying results can be achieved than with a comparable single chamber drying kiln of the same production capacity. Standard batch kilns further require high energy input during the first two drying stages and little energy input in the final two stages. This means that heating plant must be rated to deliver the required heat in the initial two stages, which then lies relatively idle for the subsequent stages. By contrast, as shown in FIG. 8 the "new continuous drying kiln" of the invention has relatively constant thermal energy demands, the peak value of which is much lower than that of the "standard batch kiln". Accordingly boiler/energy plant having a much lower rating may be used to achieve the same production level. Further, heat (typically in the form of steam or steam condense at about 100° C.) may be transferred from the first two chambers to the third and fourth chambers or to a preheating stage. This recycling of heat energy can result in a 15–20% energy saving for the timber drying process.

Further, in the present invention the temperature within chambers 3 and 4 may be controlled to reduce the amount of volatile organic chemical emissions from the timber. Such emissions are the subject of regulating control in many countries and the invention will provide compliance with Air Emission Standards and levels stipulated.

Figure 9:
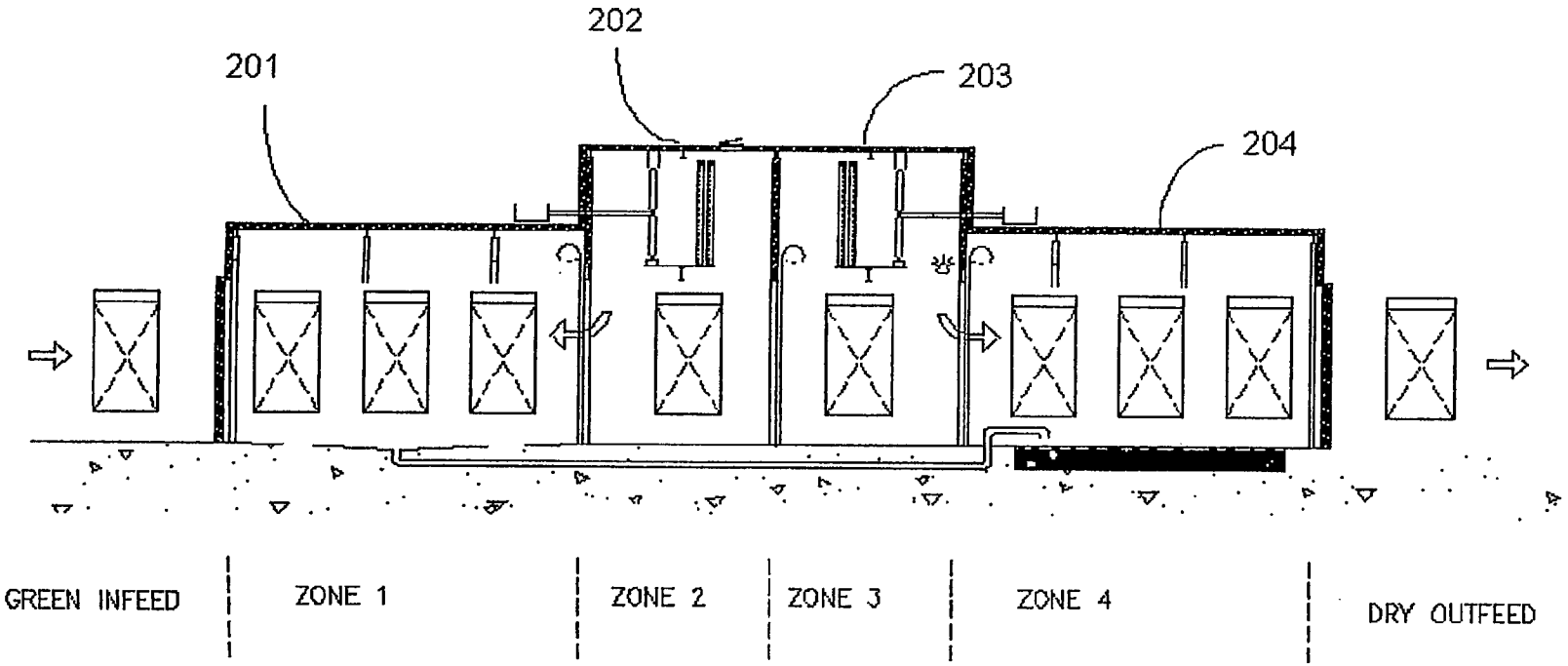
FIGS. 9 to 13 show alternative chamber arrangements.
Figure 11:
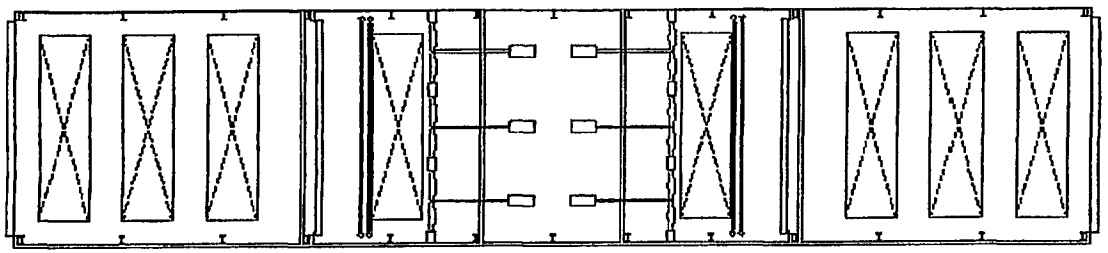

Referring now to FIG. 9 an alternative configuration is shown. Stacks of timber are initially supplied to preheating chamber 201. In this embodiment three stacks may be placed within preheating chamber 201 so that each stack is heated for a sufficient time before entering into rapid drying chamber 202. From rapid drying chamber 202 a stack is passed to a drying and equalising chamber 203. From drying and equalising chamber 203 the stack passes to steam reconditioning chamber 204. Three stakes are provided within chamber 204 so that they are exposed to the steam reconditioning for a sufficient period of time. The stacks move sequentially through the chambers at predetermined intervals. It will be appreciated that the length of the chambers may be adjusted so that the stakes are exposed to the conditions in each chamber for the required period of time.

In the embodiment shown steam from chamber 202 is supplied to chamber 201 to preheat the stacks therewithin. Steam from chamber 203 is supplied to chamber 204 to provide the required steam reconditioning. The supply of steam from chambers 202 into 203 to chambers 201 and 204 is controlled to ensure that the desired conditions are maintained.

Figure 10:
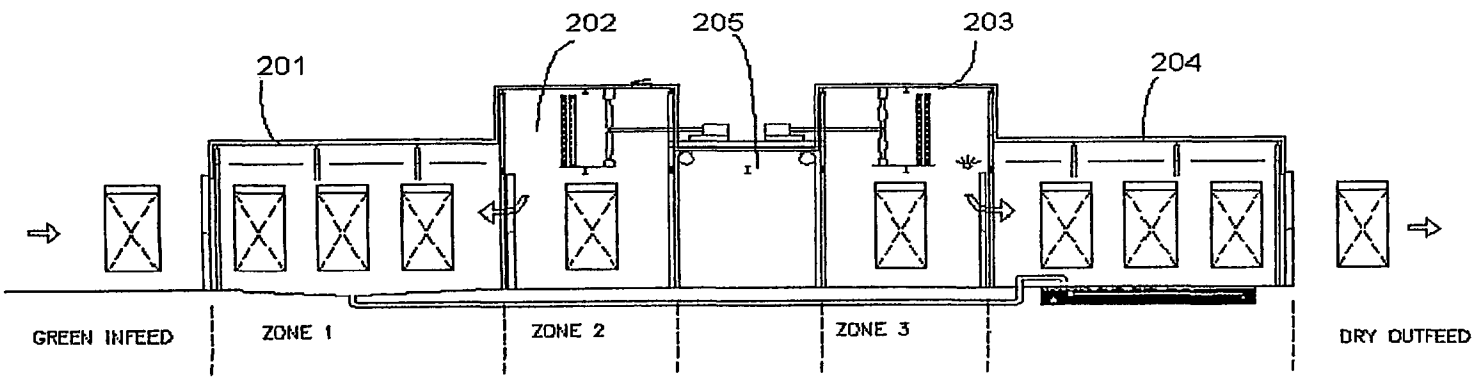
Figure 13:
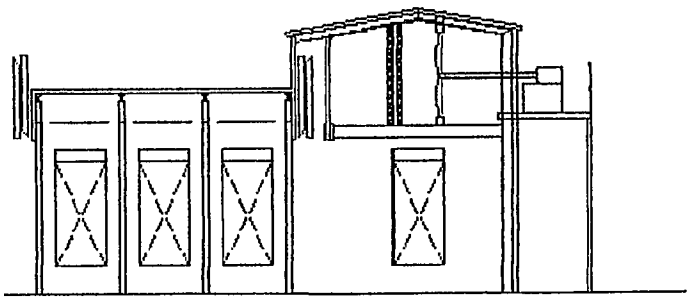

Referring now to FIG. 10 an alternative embodiment is shown. This embodiment is similar to the embodiment shown in FIG. 9 except that the fan motor arrangement is different and an intermediate chamber 205 is provided between chambers 202 and 203. Otherwise operation is as per that described in relation to FIG. 9.

Figure 12:
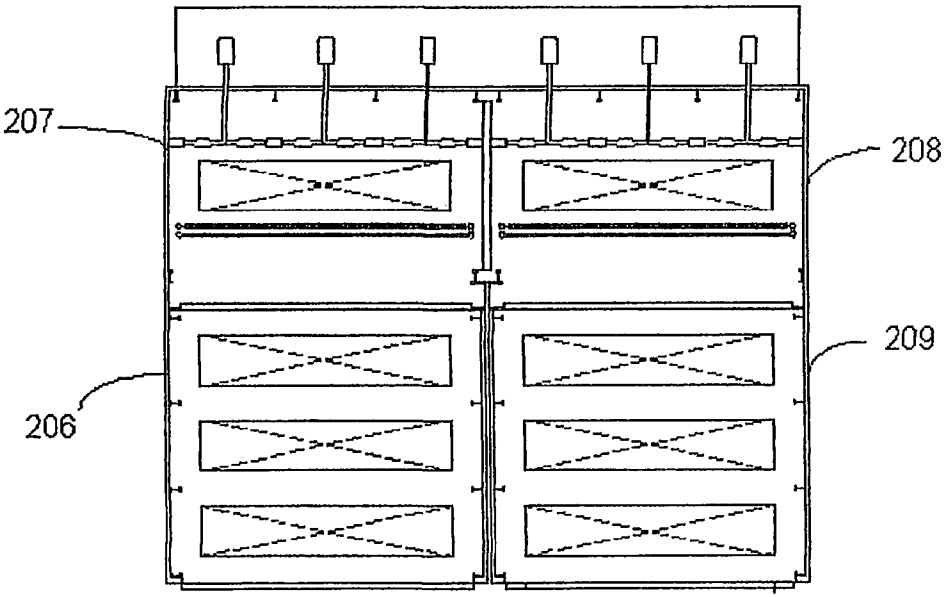

Referring now to FIG. 12 an alternative embodiment is shown in which the stacks are exposed to the same processing steps as in the kiln of FIG. 9. In this embodiment however the chambers are arranged in a more compact design. The stacks are initially supplied to chamber 206 and then sequentially passed to rapid drying chamber 207. The stacking chamber 207 is then moved laterally into drying an equalising chamber 208. The stack from chamber 208 then passes to steam reconditioning chamber 209. This arrangement allows processing in the same manner as outlined in FIG. 9 but is more compact.

It will be appreciated by those skilled in the art that by using separate and thermally isolated chambers in this way, the conditions experienced by the timber as it undergoes the drying process can be carefully monitored and controlled, providing a superior and more consistent end product enabling repetitive results over weeks or months of drying operations. This is particularly advantageous in high temperature operation where timber may be rapidly dried in a short time whilst maintaining timber quality. It will further be appreciated that the thermal energy requirement of the kiln will be relatively constant and of a relatively lower average level compared to previous batch timber drying kilns.

Higher efficiency of the thermal cycle reduces energy demands and thus reduces the cost of operation. Steam conditioning of timber in the final chamber enables a rapid drying schedule to be employed without significant degradation of the timber.

Where in the foregoing description, reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope of the invention as defined in the appended claims.

The invention claimed is:

1. A method of drying timber in a timber drying kiln having a plurality of chambers including the steps of:

supplying timber to a first chamber in which a dry bulb temperature is maintained between 120° to 260° C., a wet bulb temperature is maintained between 90° to 100° C. and an air speed is maintained between 8 to 18 meters per second; and transferring the timber to a further chamber in which the dry bulb temperature is maintained between 80° to 130° C., the wet bulb temperature is maintained between 70° to 100° C. and the air speed is maintained between 5 to 12 meters per second.

2. The method as claimed in claim 1 wherein the timber is transferred to the further chamber after a substantial proportion of a moisture content of the timber has been removed.

3. The method as claimed in claim 1 wherein the timber is transferred to the further chamber when a moisture content is near or approaching a fiber saturation point.

4. The method claimed in claim 1 wherein the dry bulb temperature is maintained between 140° to 150° C. within the first chamber.

5. The method as claimed in claim 1 wherein the air speed is maintained between 10 to 12 meters per second in the first chamber.

6. The method as claimed in claim 1 wherein the dry bulb temperature is maintained between 110° to 120° C. in the further chamber.

7. The method as claimed in claim 1 wherein the wet bulb temperature is maintained between 70° to 80° C. in the further chamber.

8. The method as claimed in claim 1 wherein the air speed is maintained between 5 to 8 meters per second in the further chamber.

9. The method as claimed in claim 1 wherein the timber is preheated in preheating chamber prior to being supplied to the first chamber wherein the dry bulb temperature within the first chamber is between 120° to 260° C., the wet bulb temperature is between 90° to 100° C. and the air speed is between 8 to 18 meters per second.

10. The method as claimed in claim 1 wherein the timber from the further chamber is supplied to a steam reconditioning chamber in which the dry bulb temperature is maintained between 80° to 100° C., the wet bulb temperature is maintained between 80° to 100° C. and the air speed is maintained between 8 to 15 meters per second.

11. The method as claimed in claim 1 wherein steam conditioning of the timber is performed in a final chamber to achieve substantially uniform moisture content throughout the timber.

12. A method as claimed in claim 1 wherein energy is transferred between the first chamber and the further chamber.

13. A method as claimed in claim 1 wherein timber in the further chamber is conditioned with steam so as to achieve a generally uniform moisture content throughout the timber.

* * * * *